US006840655B2

(12) United States Patent
Shen

(10) Patent No.: US 6,840,655 B2
(45) Date of Patent: Jan. 11, 2005

(54) LED LIGHT SET

(76) Inventor: Ya-Kuang Shen, 10F-7, No. 32, Yun Ji Rd., Taipei (TW)

( * ) Notice: Subject to any disclaimer, the term of this patent is extended or adjusted under 35 U.S.C. 154(b) by 0 days.

(21) Appl. No.: 10/455,527

(22) Filed: Jun. 6, 2003

(65) Prior Publication Data

US 2004/0246719 A1 Dec. 9, 2004

(51) Int. Cl.[7] ..... F21V 21/00
(52) U.S. Cl. ..... 362/249; 362/227; 362/252
(58) Field of Search ..... 362/227, 238, 362/240, 252, 558

(56) References Cited

U.S. PATENT DOCUMENTS 4,271,458 A * 6/1981 George, Jr. ..... 362/236
5,113,329 A * 5/1992 Lin ..... 362/238
6,158,882 A * 12/2000 Bischoff, Jr. ..... 362/488
6,361,186 B1 * 3/2002 Slayden ..... 362/249
6,604,841 B2 * 8/2003 Liu ..... 362/252
6,652,112 B1 * 11/2003 Lucarelli ..... 362/145

* cited by examiner

*Primary Examiner*—John Anthony Ward
(74) *Attorney, Agent, or Firm*—Birch, Stewart, Kolasch & Birch, LLP

(57) ABSTRACT

A LED light set includes a flexible plastic tube, the flexible plastic tube having an axially extended passage hole and light guide hole and a plurality of inside lamp holes radially extended between the passage hole and the light guide hole, two metal wire conductors embedded in the flexible plastic tube, LEDs respectively mounted in the inside lamp holes inside the flexible plastic tube, each LED having two legs extended in reversed directions and suspended in the passage hole, and lead wires connecting the legs of the LEDs in series.

9 Claims, 4 Drawing Sheets

LED LIGHT SET

BACKGROUND OF THE INVENTION

1. Field of the Invention

The present invention relates to a light set and, more particularly, to a LED light set, which provides a better sideway illumination, is easy to manufacture, and has lead wires well protected on the inside.

2. Description of the Related Art

Neon lights are intensively used in signboards and houses for decoration. However, neon lights are expensive and not durable in use. Recently, non-neon light type flexible light bars are developed to substitute for neon lights. FIG. 3 shows an example of these flexible light bars. As illustrated in FIG. 3, the flexible light bar comprises a transparent outer sleeve 5, a plastic inner tube 50 mounted in the outer sleeve 5 and defining an axially extended passage hole 51, two wire conductors 52 axially embedded in the plastic inner tube 50 and arranged in parallel, and a series of bulbs 60 mounted in the passage hole 51 inside the plastic inner tube 50 and electrically connected to the wire conductors 52. When turned on, the light of the bulbs 60 passes through the plastic inner tube 50 and the outer sleeve 5 to the outside. This design of flexible light bar is still not satisfactory in function. Because the bulbs 60 are arranged along the axis of the passage hole 51, the major part of the light of the bulbs 60 passes axially forwards, and only a small part of the light of the bulbs 60 passes radially through the peripheral wall of the inner tube 50 and the peripheral wall of the outer sleeve 5. Further, the bulbs 60 consume much electric energy, and produce heat during operation.

FIG. 4 shows another design of flexible light bar according to the prior art. According to this design, the flexible light bar comprises an outer sleeve 7, a plastic core 70 axially fitted into the outer sleeve 7, the plastic core 70 having a plurality of radial through holes 72, two wire conductors 71 axially embedded in the periphery of the plastic core 70 and arranged in parallel, a plurality of bulbs 80 respectively mounted in the radial through holes 72, and a lead wire 81 connecting the legs of the bulbs 80 in series. This design of flexible light bar still has drawbacks. Because the lead wire 81 extends to the outside of the flexible light bar, it tends to be stretched or damaged by an external object. Further, the bulbs 80 consume much electric energy, and produce heat during operation.

SUMMARY OF THE INVENTION

The present invention has been accomplished under the circumstances in view. It is the main object of the present invention to provide a LED light set, which eliminates the aforesaid drawbacks. It is another object of the present invention to provide a LED light set, which provides a better sideway illumination. It is another object of the present invention to provide a LED light set, which is easy to manufacture. It is still another object of the present invention to provide a LED light set, which has the lead wires well protected against external objects.

To achieve these and other objects of the present invention, the LED light set comprises a flexible plastic tube, the flexible plastic tube having an axially extended passage hole and light guide hole and a plurality of inside lamp holes radially extended between the passage hole and the light guide hole, two metal wire conductors embedded in the flexible plastic tube, LEDs respectively mounted in the inside lamp holes inside the flexible plastic tube, each LED having two legs extended in reversed directions and suspended in the passage hole, and lead wires connecting the legs of the LEDs in series.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
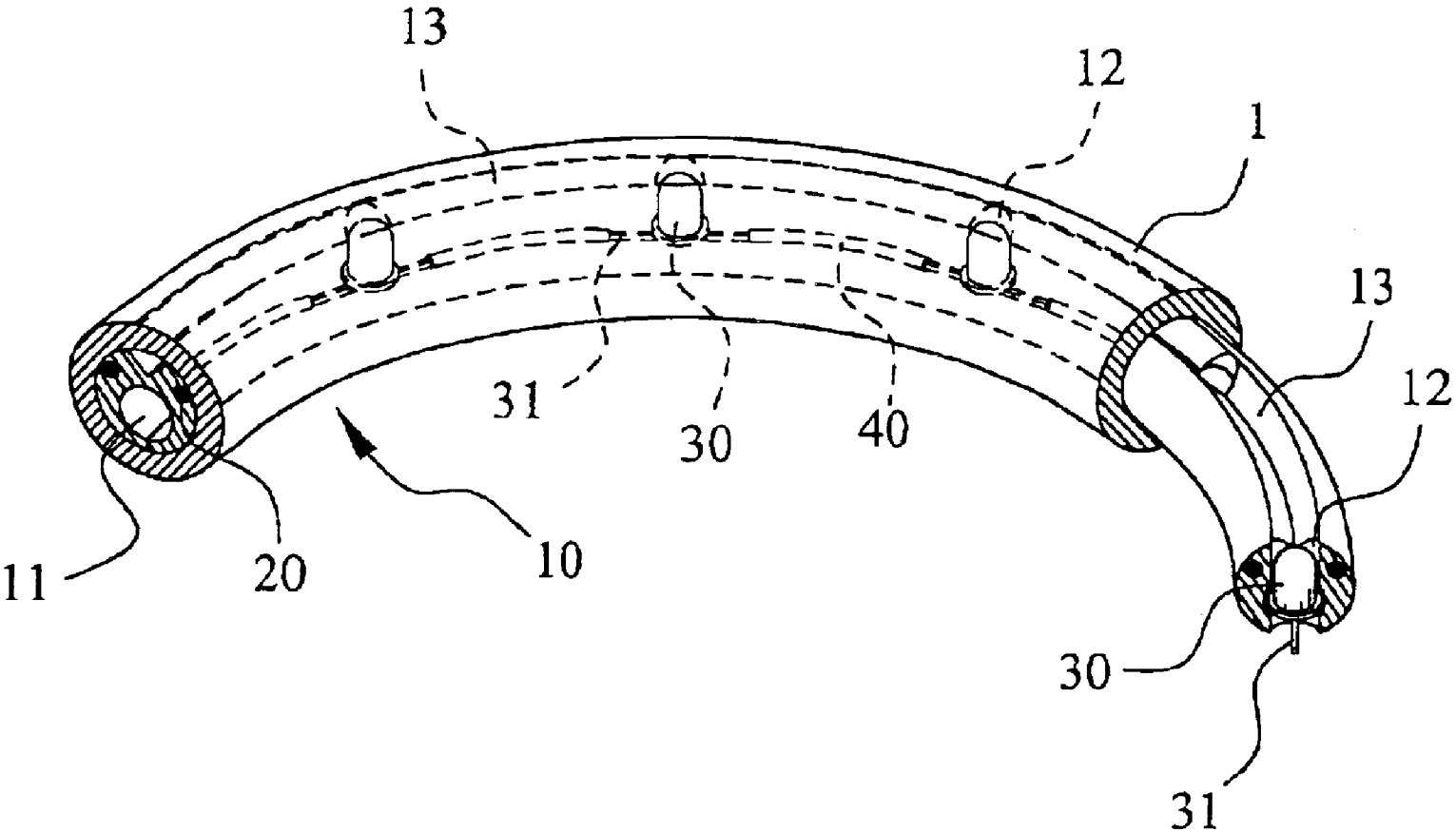
FIG. 1 is a cutaway view of a LED light set according to the present invention.
Figure 2:
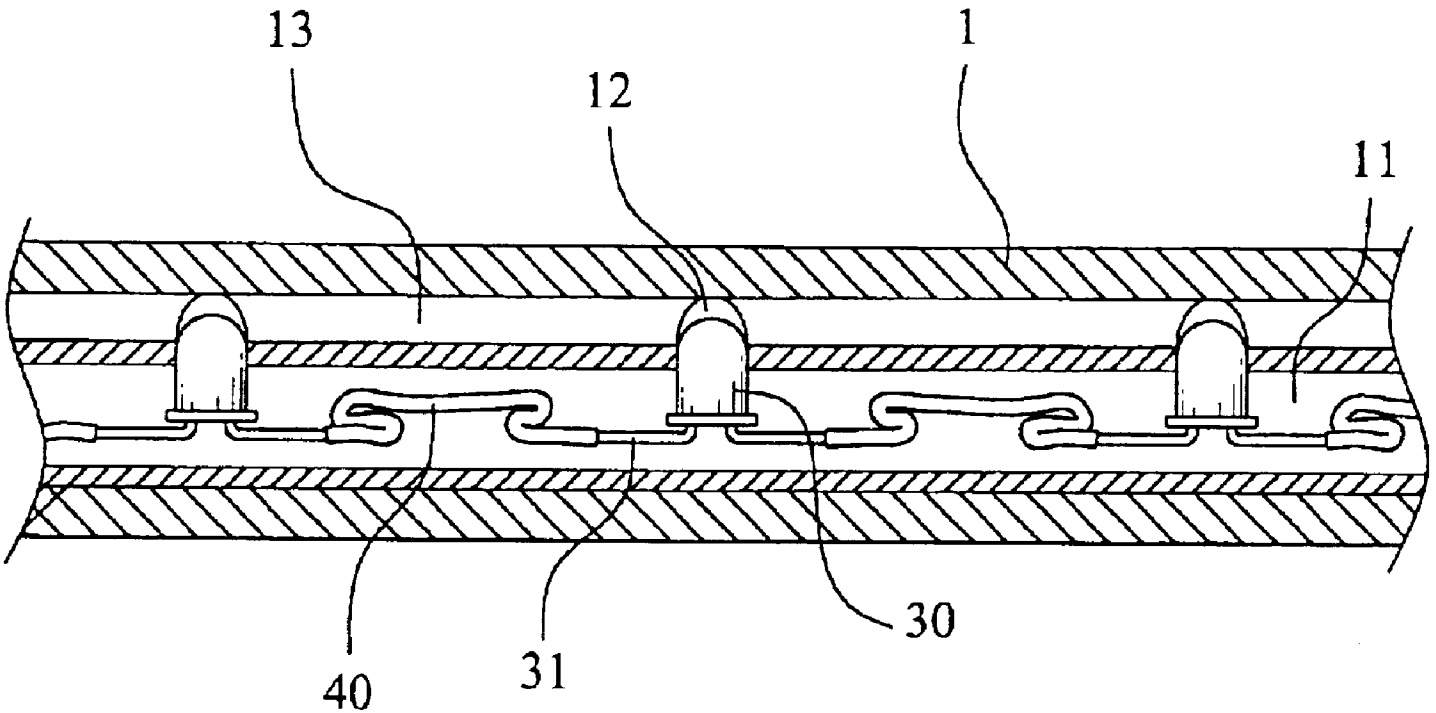
FIG. 2 is a sectional view of the LED light set according to the present invention.
Figure 3:
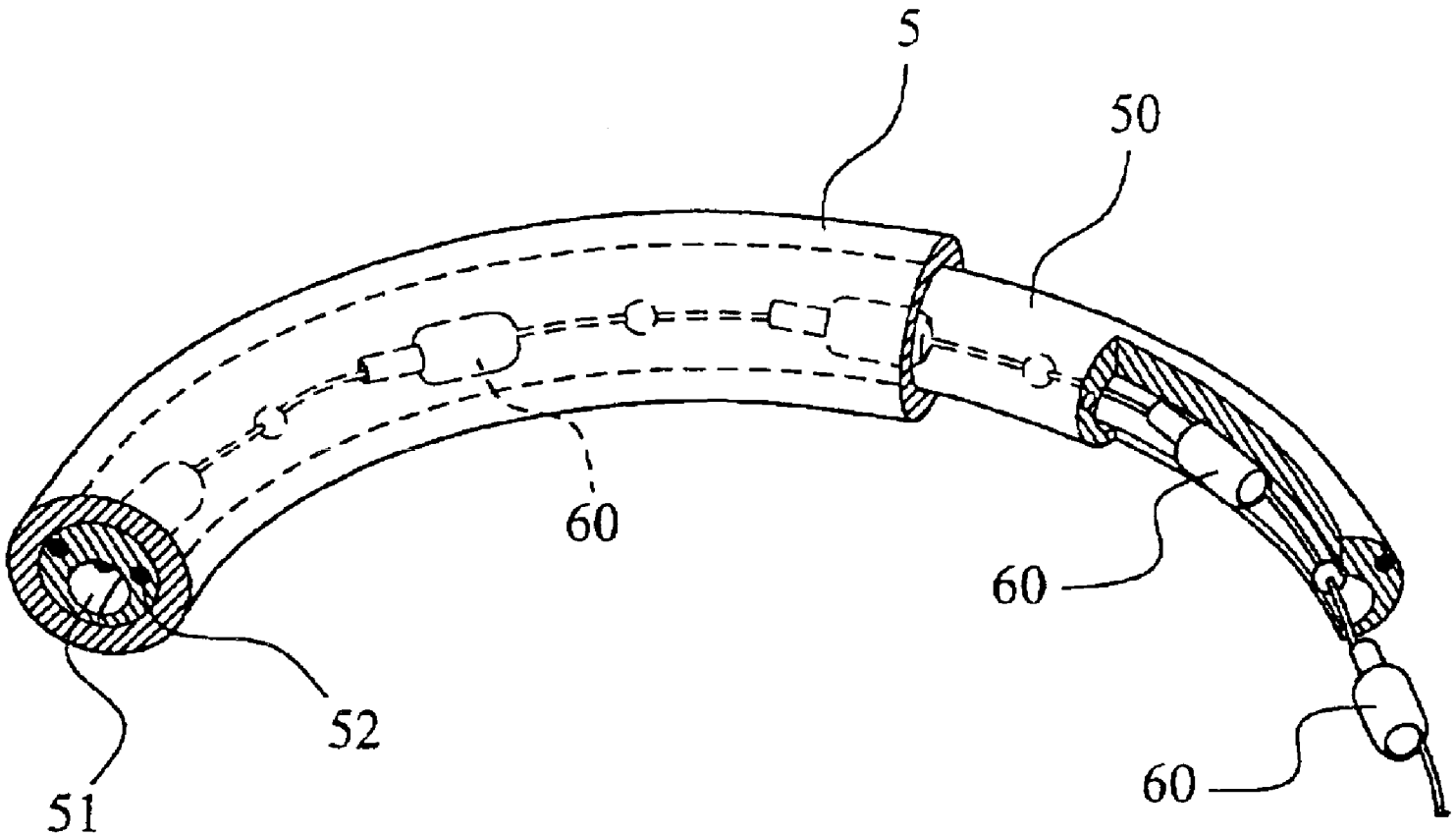
FIG. 3 (PRIOR ART)
FIG. 3 is a cutaway view of a flexible light bar according to the prior art.
Figure 4:
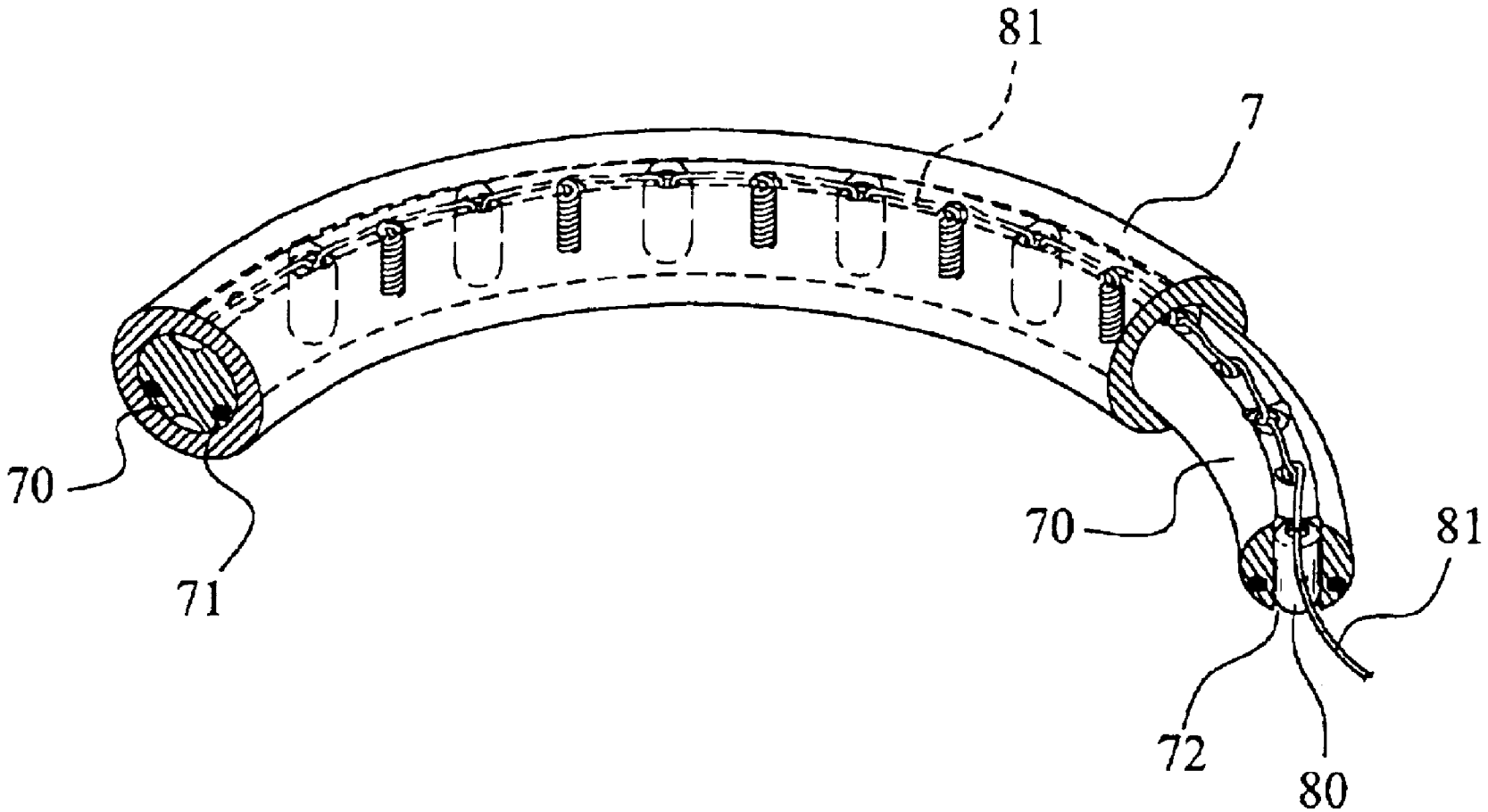
FIG. 4 (PRIOR ART)
FIG. 4 is a cutaway view of another structure of flexible light bar according to the prior art.

Referring to FIGS. 1 and 2, a LED light set in accordance with the present invention is shown comprising a flexible plastic tube 10. The flexible plastic tube 10 has an axially extended passage hole 11, an axially extended light guide hole 13, a plurality of inside lamp holes 12 radially connected between the passage hole 11 and the light guide hole 13. Two metal wire conductors 20 are respectively symmetrically embedded in the flexible plastic tube 10. A plurality of LEDs (light emitting diodes) 30 are respectively mounted in the inside lamp holes 12 inside the flexible plastic tube 10, each having two legs 31 extended in reversed directions and suspended in the passage hole 11. The legs 31 of the LEDs 30 are connected in series by lead wires 40.

As indicated above, the invention has advantages as follows:

1. Because the LEDs are radially arranged inside the flexible plastic tube, the LED light set provides strong sideway illumination.
2. Because the legs of the LEDs and the lead wires are received in the passage hole inside the flexible plastic tube, the assembly process of the LED light set is simple and time-saving, and the lead wires are well protected by the flexible plastic tube against external objects.
3. Because LEDs are used instead of bulbs, the LED light set is safe and durable in use and, does not produce heat during operation.

A prototype of LED light set has been constructed with the features of FIGS. 1 and 2. The LED light set functions smoothly to provide all of the features discussed earlier.

Although a particular embodiment of the invention has been described in detail for purposes of illustration, various modifications and enhancements may be made without departing from the spirit and scope of the invention.

Accordingly, the invention is not to be limited except as by the appended claims.

What the invention claimed is:

1. A LED light set comprising:

a flexible plastic tube, said flexible plastic tube having a passage hole axially extended through two distal ends thereof, and a plurality of inside lamp holes radially extended from said passage hole toward the periphery of said flexible plastic tube;

two wire conductors respectively symmetrically embedded in said flexible plastic tube;

a plurality of LEDs (light emitting diodes) respectively mounted in said inside lamp holes inside said flexible plastic tube, said LEDs each having opposed first and second ends and two legs extended in reversed directions and suspended in said passage hole inside said flexible plastic tube, each of the legs being connected to a first end of the LEDs and the first ends of the LEDs being further from the periphery of the flexible plastic tube than the second ends; and a plurality of lead wires mounted in said passage hole to connect the legs of said LEDs in series.

2. The LED light set as claimed in claim 1, wherein said flexible plastic tube has a light guide hole axially extended through the two distal ends thereof in parallel to said passage hole and in communication with said inside lamp holes, said light guide hole being relatively closer to the periphery of said flexible plastic tube than said passage hole.

3. The LED light set as claimed in claim 1, wherein the passage hole is at a center of the light set.

4. The LED light set as claimed in claim 2, wherein the passage hole is at a center of the light set and a single channel is provided as the light guide hole.

5. The LED light set as claimed in claim 1, wherein LEDs are arranged in a same orientation in the light set.

6. The LED light set as claimed in claim 1, wherein the passage hole is at a center of the light set and wherein the legs of the LEDs are in the passage hole.

7. The LED light set as claimed in claim 1, wherein the passage hole is further from the periphery of the flexible plastic tube than the lamp holes.

8. The LED light set as claimed in claim 1, wherein first end of the LEDs is in the passage hole and wherein the passage hole is at a center of the light set.

9. The LED light set as claimed in claim 1, wherein the second end of the LEDs is at a light guide hole, the light guide hole extending axially within the flexible plastic tube through the two distal ends thereof.

* * * * *